US011035595B2

(12) United States Patent
Jansen et al.

(10) Patent No.: US 11,035,595 B2
(45) Date of Patent: Jun. 15, 2021

(54) RECUPERATED SUPERHEAT RETURN TRANS-CRITICAL VAPOR COMPRESSION SYSTEM

(71) Applicant: Rolls-Royce North American Technologies Inc., Indianapolis, IN (US)

(72) Inventors: Eugene C. Jansen, Stafford, VA (US); Eric S. Donovan, Fischers, IN (US)

(73) Assignee: ROLLS-ROYCE NORTH AMERICAN TECHNOLOGIES INC., Indianapolis, IN (US)

( * ) Notice: Subject to any disclaimer, the term of this patent is extended or adjusted under 35 U.S.C. 154(b) by 0 days.

(21) Appl. No.: 15/974,280

(22) Filed: May 8, 2018

(65) Prior Publication Data

US 2019/0056154 A1 Feb. 21, 2019

Related U.S. Application Data

(60) Provisional application No. 62/547,501, filed on Aug. 18, 2017.

(51) Int. Cl.
*F25B 40/00* (2006.01)
*F25B 49/02* (2006.01)
(Continued)

(52) U.S. Cl.
CPC ..... *F25B 9/10* (2013.01); *F25B 9/008* (2013.01); *F25B 40/00* (2013.01); *F25B 49/02* (2013.01);
(Continued)

(58) Field of Classification Search
CPC ..... F25B 2341/001; F25B 2341/0011; F25B 2400/23; F25B 9/008; F25B 2400/054
See application file for complete search history.

(56) References Cited

U.S. PATENT DOCUMENTS 4,229,949 A * 10/1980 Brandin ..... F25B 41/00 62/503
4,476,688 A * 10/1984 Goddard ..... F25B 45/00 62/149
(Continued)

FOREIGN PATENT DOCUMENTS

EP 3 098 543 A1 11/2016
JP 2004-198045 A 7/2004
(Continued)

OTHER PUBLICATIONS

European Search Report, issued in European Patent Application No. 18188470.1, dated Apr. 17, 2019, pp. 1-12, European Patent Office, Munich, Germany.
(Continued)

*Primary Examiner* — Frantz F Jules
*Assistant Examiner* — Lionel Nouketcha
(74) *Attorney, Agent, or Firm* — Brinks Gilson & Lione

(57) ABSTRACT

Methods and systems for recuperated superheat return are provided. A coolant is supplied in a vapor state to a compressor. The coolant compressed by the compressor is cooled with a gas cooler. The coolant cooled by the gas cooler is supplied to an inlet of a high pressure side of a recuperator. The coolant from an outlet of the high pressure side of the recuperator is supplied to a portion of a coolant circuit. The coolant is supplied back from the portion of the coolant circuit to an inlet of a low pressure side of the recuperator. The coolant in the low pressure side of the recuperator is heated with thermal energy transferred by the recuperator from the coolant in the high pressure side of the recuperator. The coolant in the vapor state from an outlet of the low pressure side of the recuperator is supplied to the compressor.

15 Claims, 6 Drawing Sheets

(51) Int. Cl.

| | |
|---|---|
| ***F25B 9/10*** | (2006.01) |
| ***F25B 9/00*** | (2006.01) |
| *F41B 6/00* | (2006.01) |
| *F25B 41/00* | (2021.01) |
| *F41H 13/00* | (2006.01) |

(52) U.S. Cl.
CPC ..... *F25B 41/00* (2013.01); *F25B 2309/061* (2013.01); *F25B 2341/001* (2013.01); *F25B 2341/0011* (2013.01); *F25B 2400/054* (2013.01); *F25B 2400/23* (2013.01); *F25B 2600/2515* (2013.01); *F25B 2600/2517* (2013.01); *F41B 6/006* (2013.01); *F41H 13/0043* (2013.01)

(56) References Cited

U.S. PATENT DOCUMENTS

| | | | | |
|---|---|---|---|---|
| 5,056,329 | A * | 10/1991 | Wilkinson | F25B 1/10 62/197 |
| 5,134,859 | A * | 8/1992 | Jaster | F25B 5/04 62/198 |
| 5,327,442 | A | 7/1994 | Yarborough et al. | |
| 6,536,231 | B2 * | 3/2003 | Gupte | F25B 1/00 165/140 |
| 6,845,110 | B2 | 1/2005 | Gibson | |
| 7,058,100 | B2 | 6/2006 | Vetrovec et al. | |
| 7,665,225 | B2 | 2/2010 | Goldberg et al. | |
| 8,157,503 | B2 | 4/2012 | Junod | |
| 8,191,615 | B2 | 6/2012 | So et al. | |
| 9,360,243 | B1 | 6/2016 | Cowans et al. | |
| 9,464,832 | B2 * | 10/2016 | Higashiiue | F25B 43/02 |
| 9,681,590 | B2 * | 6/2017 | Uchida | B60H 1/004 |
| 2007/0074536 | A1 | 4/2007 | Bai | |
| 2011/0185753 | A1 * | 8/2011 | Lifson | F25B 49/02 62/115 |
| 2011/0277967 | A1 | 11/2011 | Fried et al. | |
| 2012/0198878 | A1 | 8/2012 | Pellegrini | |
| 2012/0324911 | A1 | 12/2012 | Shedd | |
| 2015/0191254 | A1 * | 7/2015 | Vaisman | B64D 33/08 62/115 |
| 2016/0202003 | A1 | 7/2016 | Gerstler et al. | |
| 2016/0223234 | A1 * | 8/2016 | Vaisman | F25B 45/00 |
| 2016/0258266 | A1 | 9/2016 | Frick | |
| 2017/0082333 | A1 * | 3/2017 | Shimazu | F25B 6/04 |
| 2018/0149276 | A1 * | 5/2018 | Rosaen | F25D 17/02 |

FOREIGN PATENT DOCUMENTS

| | | | | |
|---|---|---|---|---|
| WO | WO 2004/0055454 | A1 | 7/2004 | |
| WO | WO-2004055454 | A1 * | 7/2004 | F25B 9/008 |
| WO | WO 2006/092108 | A1 | 9/2006 | |
| WO | WO-2006092108 | A1 * | 9/2006 | F25B 40/00 |
| WO | WO 2009/128271 | A1 | 10/2009 | |
| WO | WO 2017/067860 | A1 | 4/2017 | |

OTHER PUBLICATIONS

Partial European Search Report, issued in European Application No. 18188470.1, dated Jan. 3, 2019, pp. 1-13, European Patent Office, Munich, Germany.

* cited by examiner

RECUPERATED SUPERHEAT RETURN TRANS-CRITICAL VAPOR COMPRESSION SYSTEM

CROSS-REFERENCE TO RELATED APPLICATIONS

This application is a non-provisional application of U.S. provisional application 62/547,501 filed Aug. 18, 2017. The entire contents of the above-identified application is hereby incorporated by reference.

TECHNICAL FIELD

This disclosure relates to cooling systems.

BACKGROUND

From a controls perspective, a Low Pressure Receiver (LPR) architecture for a cooling system is relatively simple. A gravity-fed evaporator included in a typical LPR architecture has a dependency on gravity to provide consistent coolant flow.

One or more primary system evaporators in the LPR architecture may exhaust into a low pressure receiver (a type of vapor-liquid separator) before flow continues on to a compressor. As a result, the low pressure receiver may need to be large enough to remove saturated liquid in the flow to the compressor. Otherwise, liquid remaining in the flow to the compressor may cause serious problems in the compressor. For example, liquid that settles in the oil of the compressor may boil, which may then cause oil to foam and enter a compression chamber of the compressor. Including an over-sized low pressure receiver may help eliminate saturated liquid in the flow to the compressor.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Methods and systems for recuperated superheat return are provided. For example, in one such system, the system includes a compressor, a gas cooler, a recuperator, a thermal expansion valve, an evaporator, a vapor-liquid separator, a liquid return valve, a pressure drop element, and a mixer.

The compressor may compress a coolant that is supplied to the compressor in a vapor state. The gas cooler may cool the coolant compressed by the compressor. The recuperator may have a high pressure side and a low pressure side that are fluidly isolated from each other. Thermal energy may be transferred from the high pressure side of the recuperator to the low pressure side, thereby cooling coolant in the high pressure side and heating coolant in the low pressure side. The recuperator may receive the coolant cooled by the gas cooler at an inlet of the high pressure side. The coolant in the high pressure side is cooled in the recuperator when the thermal energy is transferred to the low pressure side. Correspondingly, the coolant in the low pressure side is heated to a vapor state. The coolant in the vapor state may be supplied to the compressor from an outlet of the low pressure side. The thermal expansion valve may receive the coolant cooled by the recuperator from an outlet of the high pressure side of the recuperator. The evaporator may receive the coolant from the thermal expansion valve and cool a thermal load with the coolant. The vapor-liquid separator may receive the coolant from the evaporator and separate the coolant into a vapor portion and a liquid portion. The liquid return valve may control a flow of the liquid portion out of the vapor-liquid separator. The pressure drop element may cause the pressure of the vapor portion of the coolant that exits the vapor-liquid separator to drop to a decreased pressure. The mixer may form a mixture of the vapor portion of the coolant at the decreased pressure and the liquid portion of the coolant received through the liquid return valve. The recuperator may receive the mixture at an inlet of the low pressure side of the recuperator.

In some examples, an interesting feature of the systems and methods described below may be that liquid coolant entering the compressor may be avoided. Alternatively, or in addition, an interesting feature of the systems and methods described below may be that a smaller and/or a less efficient vapor-liquid separator may be utilized than in some other systems. Alternatively, or in addition, an interesting feature of the systems and methods described below may be mass may be returned to the system more rapidly than in some other systems so as to more rapidly adjust to sudden onset of high thermal loads. Alternatively, or in addition, an interesting feature of the systems and methods described below may be to improve a Coefficient of Performance at high heat rejection temperature and/or pressure.

Figure 1:
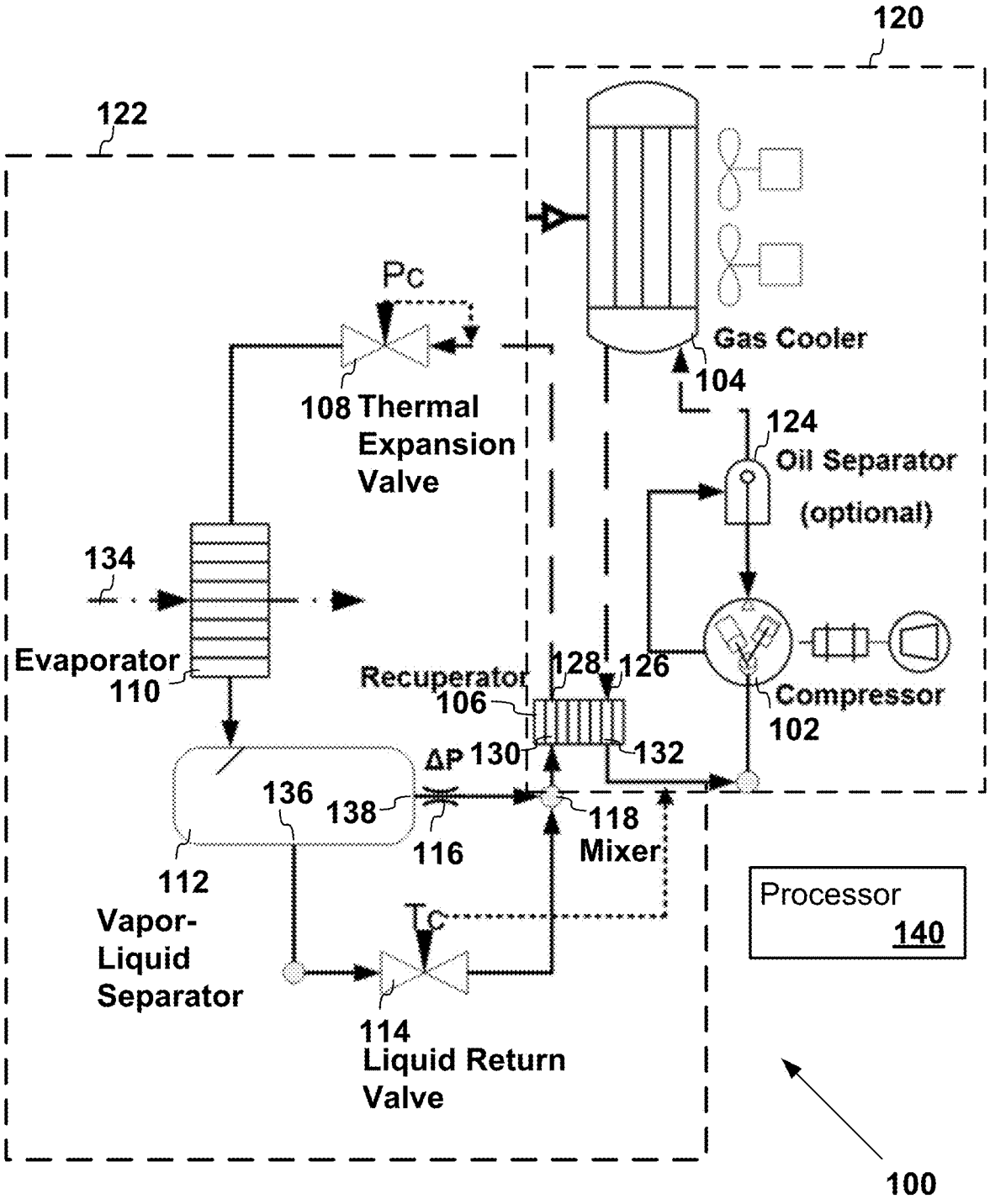
FIG. 1 is a schematic diagram of an example of a cooling system that has a recuperated superheat return (RSR) architecture.

FIG. 1 is a schematic diagram of an example of a cooling system 100 that has a recuperated superheat return architecture. The cooling system 100 shown in FIG. 1 includes a compressor 102, a gas cooler 104, a recuperator 106, a thermal expansion valve 108, an evaporator 110, a vapor-liquid separator 112 (for example, a low pressure receiver), a liquid return valve 114, a pressure drop device 116, and a mixer 118. The system 100 may include additional, fewer, and/or different components than the example shown in FIG. 1.

The pressure drop device 116 may include a means for creating a pressure drop. The pressure drop device 116 may create the pressure drop between an inlet of the pressure drop device 116 and an outlet of the pressure drop device 116. Examples of the pressure drop device 116 may include a restriction, a length of pipe or tubing, a pipe or a tubing having a cross-sectional area change, a pipe or a tubing including an obstruction, an orifice, a valve, a bent pipe, an automated valve, a venturi valve, and/or any other physical structure that causes a pressure drop on a fluid as the fluid flows through the physical structure. The pressure drop device 116 may be a passive device and/or an active device.

The vapor-liquid separator 112 may include any device configured to separate a vapor-liquid mixture into vapor and liquid portions. The vapor-liquid separator 112 may be a vessel in which gravity causes the liquid portion to settle to a bottom portion of the vessel and the vapor portion to rise to a top portion of the vessel. Alternatively, the vapor-liquid separator 112 may use centrifugal force to drive the liquid portion towards an outer edge of the vessel for removal and the vapor portion may migrate towards a center region of the vessel. In some examples, the vapor-liquid separator 112 may include a level sensor mechanism that monitors a level of the liquid in the vessel. Examples of the vapor-liquid separator may include a low pressure receiver and a flash tank.

The compressor 102 may be any mechanical device that increases a pressure of a gas by reducing the volume of the gas. Examples of the compressor 102 may include any gas compressor, such as a positive displacement compressor, a dynamic compressor, a rotary compressor, a reciprocating compressor, a centrifugal compressor, an axial compressor, and/or any combination thereof.

The mixer 118 may be any device that combines fluid received in two or more inlets into fluid that exits an outlet. An example of the mixer 118 includes a junction.

The compressor 102, the gas cooler 104, the recuperator 106, the thermal expansion valve 108, the evaporator 110, the vapor-liquid separator 112, the liquid return valve 114, the pressure drop device 116, and the mixer 118 may be in fluid communication with each other and form a coolant circuit through which a coolant may flow. Tubing may connect the components of the coolant circuit. A high pressure side of the coolant circuit may be a portion that extends from an outlet of the compressor 102 to an inlet of the thermal expansion valve 108. A low pressure side of the coolant circuit may be a portion that extends from an outlet of the thermal expansion valve 108 to an inlet of the compressor 102. In some examples, a first portion 120 of the coolant circuit may include the compressor 102, the gas cooler 104, and the recuperator 106. A second portion 122 of the coolant circuit may include the thermal expansion valve 108, the evaporator 110, the vapor-liquid separator 112, the liquid return valve 114, the pressure drop device 116, and the mixer 118.

The coolant may be any substance suitable for cooling systems. The coolant or refrigerant may be any substance suitable for a trans-critical cooling system and/or a sub-critical cooling system. Examples of the coolant may include carbon dioxide ($CO_2$), anhydrous ammonia, a halomethane, a haloalkane, a hydrofluorocarbon (HFC), chlorofluorocarbons (CFC), a hydrochlorofluorocarbon (HCFC), any two-phase refrigerants, and/or a nanofluid.

During operation of the system 100, the compressor 102 may compress the coolant, which is supplied to the compressor in a vapor state. The coolant compressed by the compressor 102 may flow to the gas cooler 104. In some examples, the compressed coolant may flow through an oil separator 124 to the gas cooler 104. The oil separator 124 may separate oil from the compressed coolant and return the oil to the compressor 102. The gas cooler 104 may cool the coolant compressed by the compressor 102. The coolant cooled by the gas cooler 104 may flow to the recuperator 106.

The recuperator 106 may have a high pressure side and a low pressure side. The recuperator 106 may include a heat exchanger that transfers heat from the coolant on the high pressure side to the coolant on the low pressure side. The recuperator 106 may receive the coolant cooled by the gas cooler 104 at an inlet 126 of the high pressure side and supply the coolant to the second portion 122 of the coolant circuit from an outlet 128 of the high pressure side. The recuperator 106 may receive the coolant returned by the second portion 122 of coolant circuit at an inlet 130 of the low pressure side of the recuperator 106. The recuperator 106 may supply the coolant to the compressor 102 from an outlet 132 of the low pressure side of the recuperator 106.

By transferring thermal energy from the high pressure side to the low pressure side, the recuperator 106 may cause the coolant to exit the outlet 132 of the low pressure side in a vapor state. Due to thermal energy transferred to the coolant before the coolant flows out of the outlet 132 of the low pressure side to the compressor, the compressor 102 receives the coolant from the recuperator 106 in the vapor state and, in some examples, superheated.

With respect to the second portion 122 of the coolant circuit, the coolant may flow from the outlet 128 of the high pressure side of the recuperator 106 to the thermal expansion valve 108. The coolant exits the thermal expansion valve 108 and flows to the evaporator 110. The evaporator 110 may cool a thermal load 134. The thermal expansion valve 108 may regulate a high pressure and/or mass flow in the system 100 to control Coefficients of Performance (COP) and/or evaporator heat duty. For example, the thermal expansion valve 108 may control high side pressure to achieve a target heat rejection and CoP may be dictated by other factors such as an ambient temperature. The system 100 may include one or more processors 140 configured to cause the thermal expansion valve 108 to regulate the high pressure side, regulate compressor speed, regulate liquid return, regulate oil return from the oil separator and regulate condenser fan(s) speed.

As a result of the recuperator 106 transferring thermal energy from the high pressure side to the low pressure side, the coolant that exits the gas cooler 104 may be cooled or sub-cooled prior to entering the thermal expansion valve 108. This cooling results in lowering the vapor quality in the flow to the evaporator 110. The lower vapor quality in the coolant entering the evaporator 110 may make for better liquid distribution and improved evaporator performance than without the lower vapor quality. In addition, the evaporator 110 may be physically smaller than an evaporator that receives the coolant without the lowered vapor quality and yet still have the same cooling capacity as the larger evaporator.

The coolant that exits the evaporator 110 flows into an inlet of the vapor-liquid separator 112. The coolant separates into a liquid and a vapor in the vapor-liquid separator 112.

The vapor-liquid separator 112 includes a liquid outlet 136 and a vapor outlet 138. An inlet of the pressure drop device 116 receives a first portion of the coolant through the vapor outlet 138 of the vapor-liquid separator 112. An inlet of the liquid return valve 114 receives a second portion of the coolant through the liquid outlet 136 of the vapor-liquid separator 112.

The first portion of the coolant exits an outlet of the pressure drop device 116 at a lower pressure than at the inlet of the pressure drop device. The second portion of the coolant exits an outlet of the liquid return valve 114. The mixer 118 mixes the first portion of the coolant with the second portion of the coolant to form a mixture. An outlet of the mixer 118 may supply the mixture of the first portion of the coolant and the second portion of the coolant to the inlet 130 of the low pressure side of the recuperator 106. The pressure drop created by the pressure drop device 116 may aid in causing the coolant to flow to the recuperator 106 without relying on gravity to cause the flow.

In some examples, the pressure drop device 116 and the mixer 118 may be one device. For example, the pressure drop device 116 may be an eductor, an ejector, and/or a venturi valve that receives the first portion of the coolant through the vapor outlet 138 of the vapor-liquid separator 112 and the second portion of the coolant through the outlet of the liquid return valve 114. An outlet of the eductor, the ejector, and/or the venturi valve may supply the mixture of the first portion of the coolant and the second portion of the coolant to the recuperator 106.

Accordingly, the second portion 122 of the coolant circuit is configured to return to the inlet 130 of the low pressure side of the recuperator 106 the mixture of the first portion of the coolant released at the outlet of the pressure drop device 116 and the second portion of the coolant supplied by the liquid outlet 136 of the vapor-liquid separator 112.

Due to the thermal energy transferred to the low pressure side of the recuperator 106, the coolant entering the inlet 130 of the low pressure side of the recuperator 106 may include liquid. The coolant entering the inlet 130 of the low pressure side may include as much as, for example, twenty percent liquid by mass, and the coolant entering the compressor 102 may be, nevertheless, in a vapor state due to the heat transferred to the coolant by the recuperator 106. Accordingly, the physical size of the vapor-liquid separator 112 may be smaller than if the system 100 did not transfer the heat to the coolant with the recuperator 106.

The processor 140 may be configured to cause the liquid return valve 114 to adjust the flow of the second portion of the coolant based on a temperature of the coolant supplied to the compressor 102. For example, the liquid return valve 114 may adjust the flow of the second portion of the coolant such that a temperature of the coolant supplied to the compressor 102 indicates that the coolant is supplied to the compressor in the vapor state, and in some examples, superheated. As another example, the liquid return valve 114 may adjust the flow of the second portion of the coolant such that a temperature of the coolant supplied to the compressor 102 remains below a threshold value. If the temperature of the coolant supplied to the compressor 102 were above the threshold value selected, then the overheated coolant may damage the compressor 102 or a subcomponent thereof.

In one example, the liquid return valve 114 may be adjusted to increase the flow of the second portion of the coolant in response to a temperature of the coolant supplied to the compressor 102 exceeding an upper value in a predetermined temperature range. Conversely, the liquid return valve 114 may be adjusted to decrease the flow of the second portion of the coolant in response to a temperature of the coolant supplied to the compressor 102 falling below a lower value in the predetermined temperature range. In other words, the processor may attempt to keep the temperature of the coolant supplied to the compressor 102 within the predetermined temperature range by causing the liquid return valve 114 to adjust the flow of the second portion of the coolant supplied by the liquid outlet 136 of the vapor-liquid separator 112.

Alternatively or in addition, the processor 140 may be configured to cause the liquid return valve 114 to adjust the flow of the second portion of the coolant based on an operation state of the system 100. The system 100 may operate, for example, in a low heat duty state or a high heat duty state. In the low heat duty state, the thermal load 134 may be relatively low compared to the high heat duty state. In contrast, in the high heat duty state, the thermal load 134 may be relatively high compared to the low heat duty state. During the low heat duty state, the compressor 102 may be operated at a speed lower than the speed during the high heat duty state.

During steady-state operation of the system 100, less liquid may be returned through the liquid return valve 114 than when transitioning from the low heat duty state to the high duty state. Steady-state operation applies to the low heat duty state and the high heat duty state.

In some examples, during steady-state operation, the system 100 may monitor a compressor discharge temperature (in other words, the temperature of the coolant at an outlet of the compressor 102) and adjust the flow of the liquid returned through the liquid return valve 114 so that the compressor discharge temperature remains at or above a lower threshold temperature and below an upper threshold temperature. The lower threshold temperature may be, for example, a temperature at which the coolant is superheated. The upper threshold temperature may be, for example, a maximum compressor discharge temperature specified by a manufacturer of the compressor 102. Accordingly, the system 100 may, for example, superheat the coolant entering the compressor 102 as much as possible without the coolant exiting the compressor 102 exceeding the maximum compressor discharge temperature.

In some examples, adjusting the flow of the second portion of the coolant from the liquid return valve 114 may not involve modifying a size of an opening in the liquid return valve 114 or otherwise actively changing any geometry of the system 100. Instead, the flow adjustment may result from inherent characteristics of the components of the system 100. For example, if the thermal load applied to the system 100 at the evaporator 110 were to decrease for any reason, then the vapor flow through the vapor outlet 138 of the vapor-liquid separator 112 may correspondingly decrease. As a result of the vapor flow through the vapor outlet 138 decreasing, the pressure drop created by the pressure drop device 116 may decrease. Due to the decrease in the pressure drop created by the pressure drop device 116, the flow of the second portion of the coolant from the liquid return valve 114 may decrease.

Figure 2:
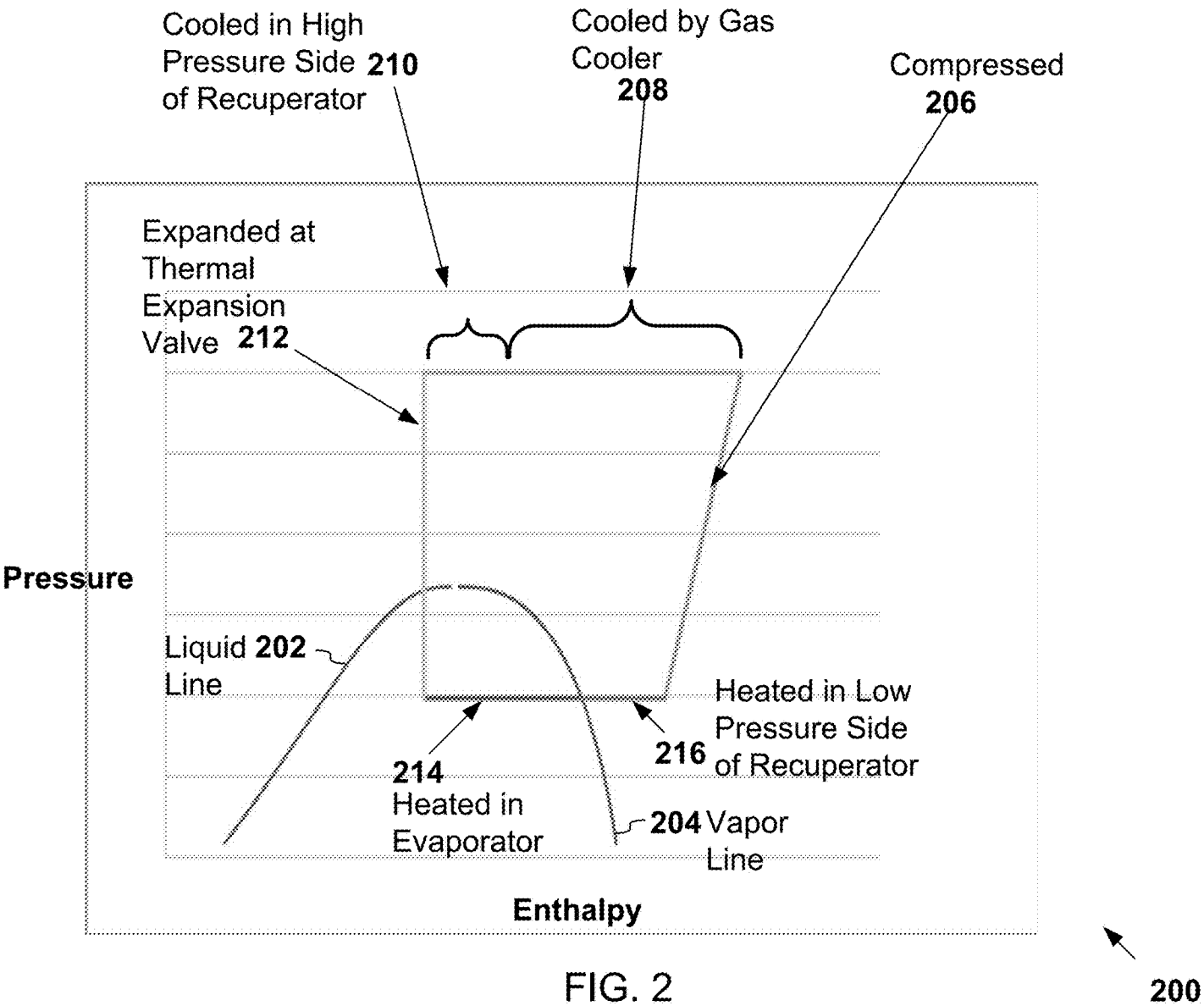
FIG. 2 is a pressure-enthalpy diagram that illustrates an example of the progression of the pressure and the enthalpy of coolant as the coolant flows through the cooling system.

FIG. 2 is a pressure-enthalpy diagram 200 that illustrates an example of the progression of the pressure and the enthalpy of the coolant as the coolant flows through the cooling system 100. The diagram 200 includes a liquid line 202 and a vapor line 204 for the coolant used in the cooling system 100.

In the example illustrated in FIG. 2, the coolant entering the compressor 102 may start as sub-critical superheated vapor. As the coolant is compressed (206) by the compressor 102, the pressure and enthalpy of the coolant increase. As the coolant is cooled (208) by the gas cooler 104, the enthalpy of the coolant decreases. As the coolant is cooled (210) in the high pressure side of the recuperator 106, the enthalpy of the coolant decreases even further. The pressure of the coolant drops below the liquid line 202 and/or the vapor line 204 when expanded (212) at the thermal expansion valve 108. When the evaporator 110 cools the thermal load 134, the coolant is correspondingly heated (214) in the evaporator 110 by the thermal load 134. The enthalpy of the coolant increases as the coolant is heated (214) in the evaporator 110. The coolant in the vapor-liquid separator 112 will be sub-critical and therefore separate into a liquid portion and a vapor portion. Similarly, the mixture of the first portion of the coolant supplied by the vapor outlet 138 and the second portion of the coolant supplied by the liquid outlet 136 will be subcritical as the mixture enters the inlet 130 of the low pressure side of the recuperator 106. The coolant in the low pressure side is then heated (216) by the recuperator 106 into the superheated region.

The processor 140 may be any device that performs logic operations. The processor 140 may be in communication with a memory (not shown). Alternatively or in addition, the processor 140 may be in communication with other components, such as the compressor 102, the liquid return valve 114, and/or the thermal expansion valve 108. The processor 140 may include a controller, a general processor, a central processing unit, a server device, an application specific integrated circuit (ASIC), a digital signal processor, a field programmable gate array (FPGA), a digital circuit, an analog circuit, a microcontroller, any other type of processor, or any combination thereof. The processor 140 may include one or more elements operable to execute computer executable instructions or computer code embodied in the memory.

The memory may be any device for storing and retrieving data or any combination thereof. The memory may include non-volatile and/or volatile memory, such as a random access memory (RAM), a read-only memory (ROM), an erasable programmable read-only memory (EPROM), or flash memory. Alternatively or in addition, the memory may include an optical, magnetic (hard-drive) or any other form of data storage device.

The cooling system 100 may include additional, fewer, or different components than shown in FIG. 1. For example, although the evaporator 110 illustrated in FIG. 1 appears as a single evaporator, the evaporator 110 may include multiple evaporators. Alternatively or in addition, the system 100 may include one or more evaporators connected in series and/or in parallel with the evaporator 110. In some examples, the cooling system 100 may include one or more pumps for the coolant. Alternatively or in addition, the system 100 may not include the oil separator 124.

The compressor 102 may include a variable flow device. Varying the speed of the compressor 102 may regulate mass flow rate of the coolant in the system 100. Varying the mass flow rate of the coolant may have a substantial and direct effect on the thermal expansion valve 108. The processor 140 may control the variable flow device.

In the example shown in FIG. 1, the evaporator 110 cools the thermal load 134. In alternative examples, such as the example shown in FIG. 3 the evaporator 110 cools multiple thermal loads.

Figure 3:
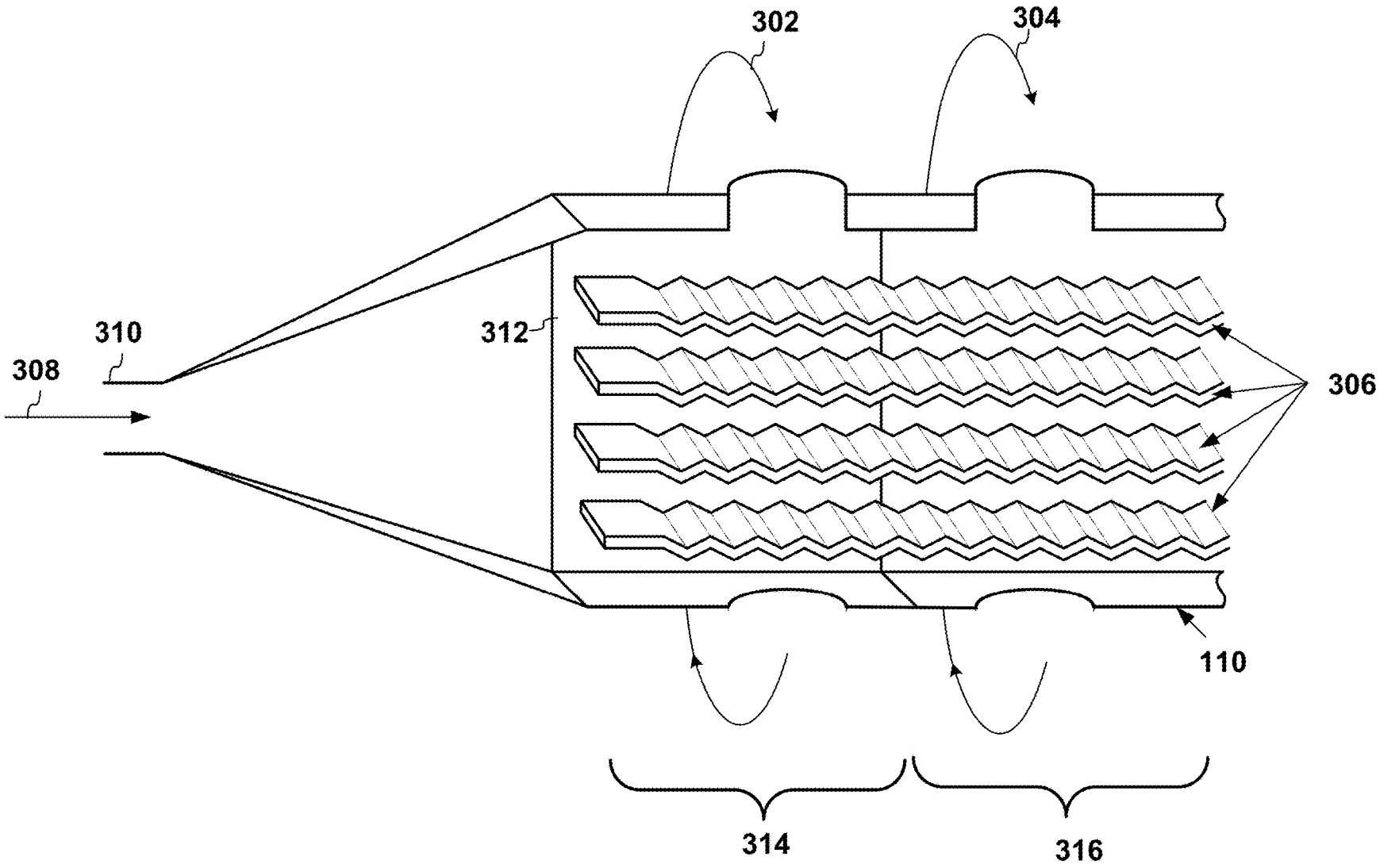
FIG. 3 illustrates a cross-sectional view of an example of the evaporator that cools two independent coolant loops.

FIG. 3 illustrates a cross-sectional view of an example of the evaporator 110 that cools two independent coolant loops, namely a hotel coolant loop 302 and a primary coolant loop 304. The hotel coolant loop 302 may cool a device that generates less heat than a device cooled by the primary coolant loop 304.

The evaporator 110 may include conduits 306 that transport a coolant 308, which enters the evaporator 110 through an inlet 310 of the evaporator 110, through to an outlet (not shown) of the evaporator 110. The coolant 308 may be in a liquid state at the inlet 310 of the evaporator 110. Accordingly, the coolant 308 may divide evenly among the conduits 306 using a simple manifold 312 that has an opening for each of the conduits 306. The manifold 312 may operate independently of gravitational forces because the coolant 308 is in the liquid state at the inlet 310 and under pressure.

The single set of the conduits 306 cool both of the independent cooling loops 302 and 304. The evaporator 110 includes a first section 314 and a second section 316. The single set of the conduits 306 extend through the first section 314 and the second section 316. The first section 314 is isolated and/or insulated from the second section 316. Coolant in the hotel coolant loop 302 may flow around the conduits 306 in the first section 314, transferring heat from the coolant in the hotel coolant loop 302 to the coolant in the conduits 306. Coolant in the primary coolant loop 304 may flow around the conduits 306 in the second section 316, transferring heat from the coolant in the primary coolant loop 304 to the coolant in the conduits 306. Accordingly, as the coolant flows through the conduits 306, the temperature of the coolant in each of the conduits 306 increases from section to section. Correspondingly, the percentage of vapor in each of the conduits 306 may rise from section to section.

Despite the potential presence of vapor in the coolant in the conduits 306 as the coolant enters the second section 316, the coolant does not need to be distributed among conduits 306 because the coolant in the conduits 306 remain isolated from each other. In contrast, if two discrete evaporators were used instead of the single evaporator 110 shown in FIG. 3, then the coolant entering the second evaporator would need to be distributed among a second set of conduits in the second evaporator. A more complex mechanism for evenly distributing the coolant among the second set of conduits in the second evaporator would be needed because of the potential presence of vapor in the coolant entering the second evaporator.

In other examples, the evaporator 110 may cool more than two independent cooling loops. The evaporator 110 may include a section for each of the independent cooling loops and the conduits 306 may extend through all of the sections.

The conduits 306 and the evaporator 110 shown in FIG. 3 are flat. However, the conduits 306 and the evaporator 110 may have any shape. For example, the evaporator 110 may be a plate heat exchanger, where the conduits 306 are defined by plates. Alternatively or in addition, the evaporator 110 may be a tubular heat exchanger, where the conduits 306 are tubes.

Figure 4:
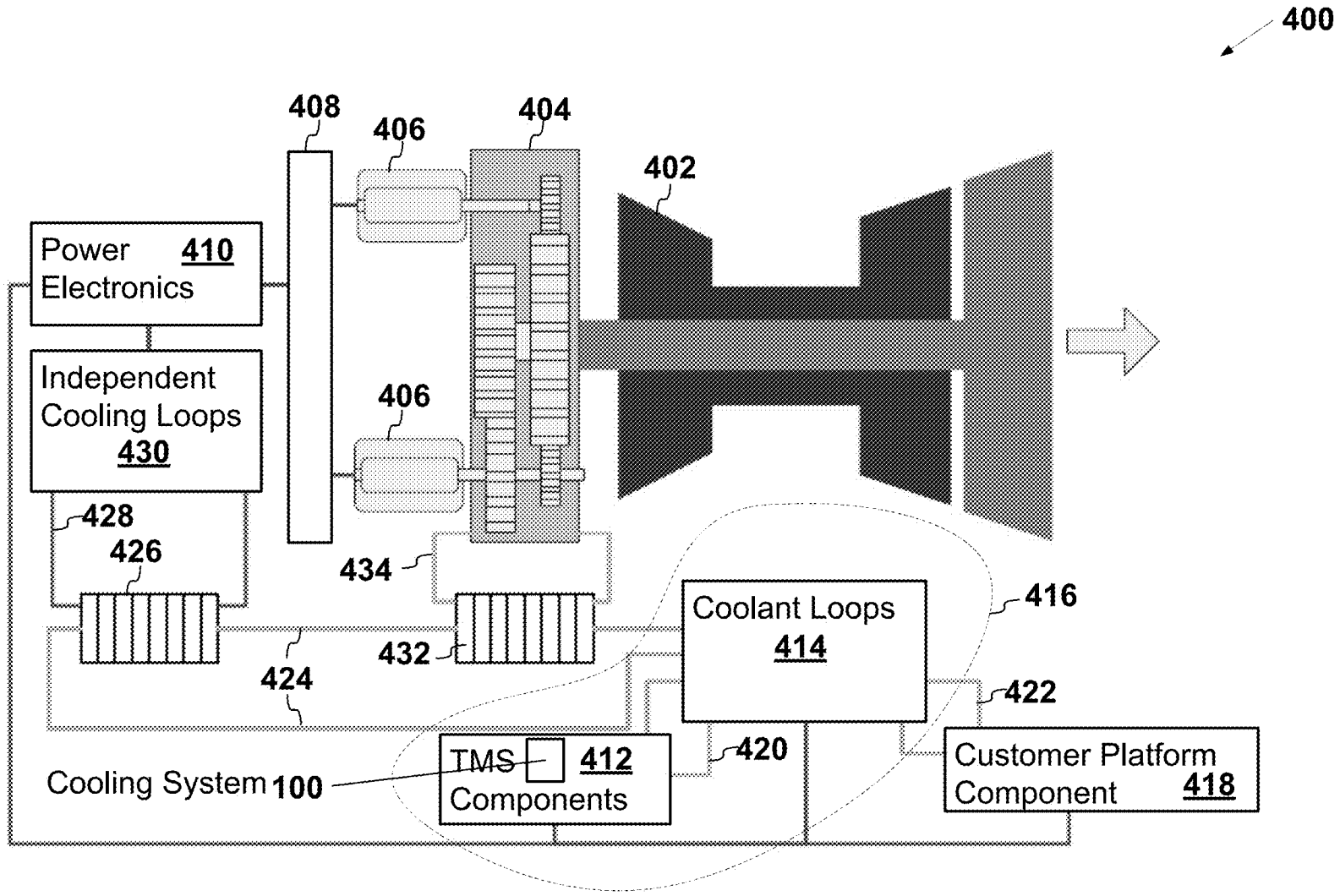
FIG. 4 is a schematic diagram of an example of an integrated power and thermal management system that includes the cooling system.
Figure 5:
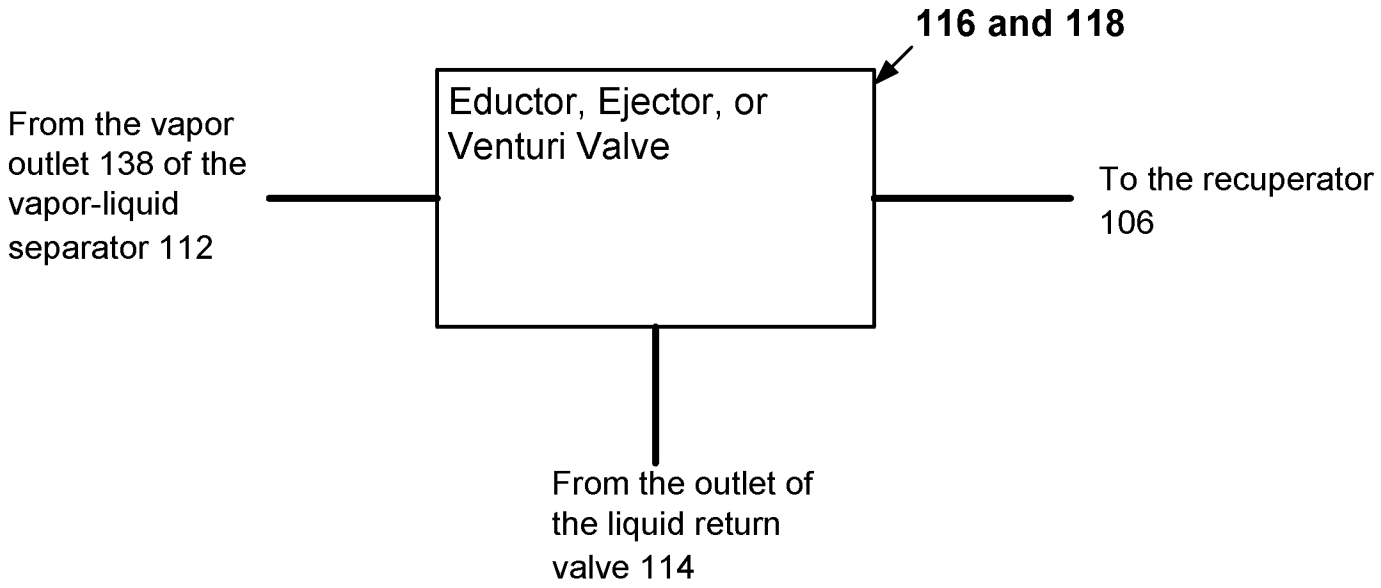
FIG. 5 illustrates an example where the pressure drop element and the mixer are integral components of an eductor, an ejector, or a venture valve.
Figure 6:
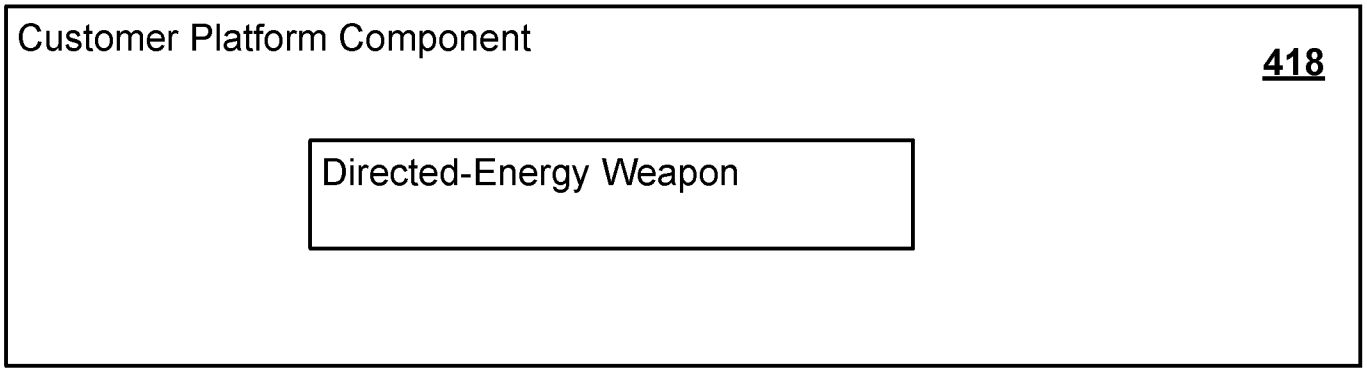
FIG. 6 illustrates an example of a directed-energy weapon included in the customer platform component 418.

FIG. 4 illustrates a schematic of an example of an integrated power and thermal management system 400 that includes the cooling system 100. The IPTMS 400 may include an engine 402, a gearbox 404, a generator 406 (two generators are shown in FIG. 4), an electrical bus 408 for the generator 406, power electronics 410, thermal management system components 412, and thermal management coolant loops 414. The thermal management system components 412 may include the cooling system 100.

The engine 402 may include any source of mechanical power that can drive the generator 406. Examples of the engine 402 may include a gas turbine engine, an internal combustion engine, a gas engine, a reciprocating engine, a diesel engine, a turbo fan, any other type of engine, propeller(s) of a wind turbine, and any other source of mechanical power. The engine 402 represented in FIG. 4 is a gas turbine engine.

The gearbox 404 may include any device that performs speed and/or torque conversions from a rotating power source to another device. Examples of the gearbox 404 may include gears, a gear train, a transmission, or any other type of device that performs rotational speed and/or torque conversions.

The generator 406 may include any type of electrical generator. Examples of the generator 406 may include a synchronous generator, an induction generator, an asynchronous generator, a permanent magnet synchronous generator, an AC (Alternating Current) generator, a DC (Direct Current) generator, a synchronous generator with stator coils, or any other device that converts mechanical power to electric power.

The electrical bus 408 may include any connector or connectors that conduct electricity. Examples of the electrical bus 408 may include a busbar, a busway, a bus duct, a solid tube, a hollow tube, a wire, an electrical cable, or any other electrical conductor.

The power electronics 410 may include any device or combination of devices that control and/or convert electric power. Examples of the power electronics 410 may include a power converter, a rectifier, an AC to DC converter, a DC to DC converter, a switching device, a diode, a thyristor, an inverter, a transistor, and a capacitor. The power electronics 410 may include semiconductor and/or solid state devices.

The thermal management system components 412 may include any component of a thermal management system. Examples of the thermal management system components 412 may include the cooling system 100, a thermal energy storage, a vapor cycle system (VCS), a conventional air cycle system (ACS), a compressor, a valve, a gas cooler, a heat exchanger, a recuperator, an evaporator, a condenser, a battery, a coolant pump, a controller, and any other component of any type of cooling system. The thermal management system components 412 together and/or separately may have a capability to provide cooling and/or heating.

As described in more detail below, the cooling and/or heating provided by the thermal management system components 412 may be distributed by the coolant through the thermal management coolant loops 414. In more general terms, the combination of the thermal management system components 412 and the thermal management coolant loops 414 form a thermal management system 416. The thermal management system 416 may provide cooling and/or heating to one or more target devices or target components. These target devices may impose the thermal load 134 on the cooling system 100.

During operation of the integrated power and thermal management system 400 (IPTMS), the IPTMS 400 may provide electrical power to a customer platform component 418. Alternatively or in addition, the IPTMS 400 may cool and/or heat the customer platform component 418. The electrical power may by generated by the generator 406 of the IPTMS 400 and the cooling and/or the heating may be provided by the thermal management system 416 of the IPTMS 400. For example, the cooling system 100 may provide the cooling at least part of the time.

The customer platform component 418 may include any device or combination of devices that consumes electricity that may benefit from cooling and/or heating. Examples of the customer platform component 418 may include solid state electronics, a light-emitting diode (LED), an analog circuit, a digital circuit, a computer, a server, a server farm, a data center, a hoteling circuit such as vehicle electronics, a vehicle, an aircraft, a directed-energy weapon, a laser, a plasma weapon, a railgun, a microwave generator, a pulse-powered device, a satellite uplink, an electric motor, an electric device, or any other electronic device that may benefit from heating and/or cooling.

The integrated power and thermal management system 400 may be considered "integrated" because electrical power generated by the IPTMS 400 may power devices within the IPTMS 400, such as components of the thermal management system 416. For example, the IPTMS 400 may provide electrical power to compressor 102 of the cooling system 100. Alternatively or in addition, the thermal management system 416 may cool and/or heat components of the IPTMS 400, such as the power electronics 410, the gearbox 404, or any component of the engine 402.

As mentioned above, the cooling and/or heating provided by the thermal management system components 412 may be distributed by a coolant via the thermal management coolant loops 414. The thermal management coolant loops 414 may include independent loops in which coolant is circulated using, for example, pumps. Heat may be exchanged between two independent loops using a heat exchanger, such as a recuperator, an evaporator, or a condenser.

For example, a first loop 420 may be cooled by the thermal management system components 412. The cooled coolant in the first loop 420 may cool a coolant in a second loop 422 via a heat exchanger (not shown). In one such example, the first loop 420 may include the cooling circuit of the cooling system 100, the heat exchanger may include the evaporator 110 of the cooling system 100, and the second loop 422 may include the primary coolant loop 304. In cooling the coolant in the second loop 422, the coolant in the first loop 420 may become warmer. The warmed coolant in the first loop 420 may be pumped back to the thermal management system components 412 where the coolant is again cooled. Meanwhile, the cooled coolant in the second loop 422 may be pumped to the customer platform component 418 where the coolant cools the customer platform component 418. In cooling the customer platform component 418, the coolant in the second loop 422 may become warmer. The warmed coolant in the second loop 422 may be pumped back to the heat exchanger where the coolant is again cooled by the first loop 420 via the heat exchanger.

In another example, the cooled coolant in the first loop 420 may cool a coolant in a third loop 424 via a heat exchanger (not shown) in a similar manner. The cooled coolant in the third loop 424 may cool the power electronics 410 by passing through a power electronics heat exchanger 426 that cools a coolant in a fourth loop 428. The cooled coolant in the fourth loop 428 may cool the power electronics 410 and/or cool one or more additional independent cooling loops 430 that in turn cool the power electronics 410. In some examples, the third loop 424 may include the hotel coolant loop 302 and the heat exchanger may include the evaporator 110 of the cooling system 100.

Alternatively or in addition, the cooled coolant in the third loop 424 (or the warmed coolant in the third loop 424 that exits the power electronics heat exchanger 426) may pass through a gearbox heat exchanger 432. The coolant in the third loop 424 that passes through the gearbox heat exchanger 432 may cool oil in an oil loop 434 that flows through the gearbox 404. In such a configuration, the thermal management system 416 may cool the oil in the gearbox 404.

The thermal management coolant loops 414, such as the first loop 420, the second loop 422, the third loop, 424, and the fourth loop 428, that are illustrated in FIG. 4 are simply examples of the thermal management coolant loops 414. In other examples, the thermal management coolant loops 414 may include additional, fewer, or different coolant loops than shown in FIG. 4. Alternatively or in addition, the thermal management system 416 may cool additional, fewer, or different components of the IPTMS 400 than shown in FIG. 4.

If the customer platform component 418 includes a directed-energy weapon or any a pulse-powered device, the thermal load 134 placed on the cooling system 100 by the customer platform component 418 may vary substantially over time. The differences between the peaks of the thermal load 134 and the valleys of the thermal load 134 may also be substantial.

With respect to generating electrical power, the engine 402 may cause a shaft of the generator 406 to rotate via the gearbox 404 during operation of the IPTMS 400. As the shaft of the generator 406 rotates, the generator 406 may generate electricity. The electrical bus 408 may transmit the generated electricity to the power electronics 410. The power electronics 410 may transform, control, and/or store the generated electricity. For example, the power electronics 410 may convert AC current generated by the generator 406 into DC current for delivery to the customer platform component 418. The power electronics 410 may deliver electricity to one or more components of the thermal management system 416 and/or to any other component of the IPTMS 400.

The IPTMS 400 may include additional, fewer, or different components than shown in FIG. 4. For example, the IPTMS 400 may include additional or fewer heat exchangers than shown in FIG. 4. As another example, the IPTMS 400 may not include the additional independent cooling loops 430 that cool the power electronics 410. In still another example, the power electronics 410 may be integrated with the generator 406 so as to eliminate the discrete electrical bus 408 shown in FIG. 4. In yet another example, the IPTMS 400 may include a single generator. In some examples, the IPTMS 400 may not include the gearbox 404. Instead, the generator 406 may be directly coupled to a mechanical output, such as a shaft, of the engine 402.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A cooling system comprising:

a compressor configured to compress a coolant supplied to the compressor in a vapor state;

a gas cooler configured to cool the coolant compressed by the compressor; and a recuperator having a high pressure side and a low pressure side, wherein the recuperator, the gas cooler, and the compressor are included in a first portion of a coolant circuit, and the recuperator is configured to:

receive the coolant cooled by the gas cooler at an inlet of the high pressure side, supply the coolant to a second portion of the coolant circuit from an outlet of the high pressure side, receive the coolant returned by the second portion of the coolant circuit at an inlet of the low pressure side, transfer heat from the coolant on the high pressure side to the coolant on the low pressure side, and supply the coolant to the compressor from an outlet of the low pressure side.

2. The cooling system of aspect 1, wherein the second portion of the coolant circuit includes a vapor-liquid separator having a liquid outlet and a vapor outlet, and the second portion of the coolant circuit is configured to return the coolant, which includes coolant that exits the liquid outlet of the vapor-liquid separator, to the low pressure side of the recuperator.

3. The cooling system of aspect 2, wherein the second portion of the coolant circuit includes a means for creating a pressure drop, the means includes an inlet and an outlet, wherein the means is configured to create the pressure drop between the inlet and the outlet of the means, and wherein the inlet of the means is configured to receive a vapor portion of the coolant through the vapor outlet of the vapor-liquid separator, and wherein the coolant that the second portion of the coolant circuit is configured to return to the low pressure side of the recuperator includes a mixture of the vapor portion of the coolant supplied through the outlet of the means and a liquid portion of the coolant received through the liquid outlet of the vapor-liquid separator.

4. The cooling system of aspect 3, wherein the means for creating the pressure drop includes a venturi valve configured to create the pressure drop.

5. The cooling system of aspect 4, wherein the venturi valve is configured to mix the first portion of the coolant and the second portion of the coolant.

6. The cooling system of aspect 2, wherein the second portion of the coolant circuit further includes a liquid return valve, and the liquid return valve is configured to control a flow of the liquid portion of the coolant.

7. The cooling system of aspect 6, wherein a processor is configured to cause the liquid return valve to adjust the flow of the second portion of the coolant based on a temperature of the coolant supplied to the compressor.

8. The cooling system of aspect 6, wherein a processor is configured to cause the liquid return valve to adjust the flow of the second portion of the coolant such that a temperature of the coolant supplied to the compressor indicates that the coolant is supplied to the compressor in the vapor state.

9. A method comprising:

supplying a coolant in a vapor state to a compressor;

compressing the coolant with the compressor;

cooling the coolant compressed by the compressor with a gas cooler;

supplying the coolant cooled by the gas cooler to an inlet of a high pressure side of a recuperator;

supplying the coolant from an outlet of the high pressure side of the recuperator to a portion of a coolant circuit;

supplying the coolant back from the portion of the coolant circuit to an inlet of a low pressure side of the recuperator;

heating the coolant in the low pressure side of the recuperator with thermal energy transferred by the recuperator from the coolant in the high pressure side of the recuperator; and supplying the coolant in the vapor state from an outlet of the low pressure side of the recuperator to the compressor.

10. The method of aspect 9 further comprising:

reducing a pressure of a vapor portion of the coolant to a reduced pressure, the vapor portion of the coolant received through a vapor outlet of a vapor-liquid separator included in the portion of the coolant circuit;

adjusting a flow of a liquid portion of the coolant, the liquid portion of the coolant received from a liquid outlet of the vapor-liquid separator; and mixing the vapor portion of the coolant at the reduced pressure with the liquid portion of the coolant to form a mixture of the liquid portion of the coolant and the vapor portion of the coolant, wherein the mixture is the coolant supplied back from the portion of the coolant circuit to the inlet of the low pressure side of the recuperator.

11. The method of aspect 10 wherein the reducing the pressure and the mixing are performed by a venturi valve.

12. The method of any of aspects 10 to 11, wherein adjusting the flow of the liquid portion comprises decreasing the flow in response to a decrease in a thermal load cooled by the coolant.

13. The method of any of aspects 10 to 12, wherein adjusting the flow of the liquid portion comprises increasing the flow in response to an increase in a thermal load cooled by the coolant.

14. The method of any of aspects 10 to 13, wherein adjusting the flow of the liquid portion comprises increasing the flow in response to a temperature of the coolant supplied to the compressor exceeding a threshold value.

15. The method of any of aspects 10 to 14, wherein adjusting the flow of the liquid portion comprises decreasing the flow in response to a temperature of the coolant supplied to the compressor falling below a threshold value.

16. A cooling system comprising:

a compressor configured to compress a coolant supplied to the compressor in a vapor state;

a gas cooler configured to cool the coolant compressed by the compressor; and a recuperator having a high pressure side and a low pressure side, wherein the recuperator is configured to receive the coolant cooled by the gas cooler at an inlet of the high pressure side, supply the coolant in the vapor state to the compressor from an outlet of the low pressure side, and transfer heat from the high pressure side to the low pressure side;

a thermal expansion valve configured to receive the coolant from an outlet of the high pressure side of the recuperator;

an evaporator configured to receive the coolant from the thermal expansion valve and to cool a thermal load with the coolant;

a vapor-liquid separator configured to receive the coolant from the evaporator and to separate the coolant into a vapor portion and a liquid portion;

a liquid return valve configured to control a flow of the liquid portion out of the vapor-liquid separator;

a pressure drop element configured to cause a pressure of the vapor portion of the coolant that exits the vapor-liquid separator to drop to a decreased pressure; and a mixer configured to form a mixture of the vapor portion of the coolant at the decreased pressure and the liquid portion of the coolant received through the liquid return valve, wherein the recuperator is further configured to receive the mixture at an inlet of the low pressure side.

17. The cooling system of aspect 16, wherein the pressure drop element and the mixer are integral components of an eductor or an ejector.

18. The cooling system of any of aspects 16 to 17, wherein the thermal load is imposed by a directed-energy weapon.

19. The cooling system of any of aspects 16 to 18, wherein the evaporator is configured to cool at least two independent coolant loops with a single set of conduits that transport the coolant through sections of the evaporator that correspond to the at least two independent coolant loops.

20. The cooling system of any of aspects 16 to 19, wherein the at least two independent coolant loops comprise a hotel coolant loop and a primary coolant loop.

What is claimed is:

1. A cooling system comprising:

a coolant circuit comprising a first portion and a second portion, the first portion including a recuperator, a gas cooler, and a compressor, the second portion comprising a mixer and a liquid-vapor separator;

wherein the compressor is configured to compress a coolant supplied to the compressor in a vapor state;

wherein the gas cooler is configured to cool the coolant compressed by the compressor;

wherein the recuperator has a high pressure side and a low pressure side;

wherein the vapor-liquid separator has a liquid outlet and a vapor outlet;

wherein the mixer is configured to form a liquid-vapor mixture from a vapor portion of the coolant supplied by the vapor outlet of the vapor-liquid separator and a liquid portion, only in a liquid phase, of the coolant received from the liquid outlet of vapor-liquid separator; and wherein the recuperator is configured to:

receive the coolant cooled by the gas cooler at an inlet of the high pressure side, supply the coolant to a second portion of the coolant circuit from an outlet of the high pressure side, wherein the second portion of the coolant circuit is configured to return the coolant to the low pressure side of the recuperator as the vapor-liquid mixture from the mixer, receive the vapor-liquid mixture at an inlet of the low pressure side of the recuperator, transfer heat from the coolant on the high pressure side to the coolant on the low pressure side, and supply the coolant to the compressor from an outlet of the low pressure side.

2. The cooling system of claim 1, wherein the second portion of the coolant circuit includes a means for creating a pressure drop, the means includes an inlet and an outlet, wherein the means is configured to create the pressure drop between the inlet and the outlet of the means, and wherein the inlet of the means is configured to receive the vapor portion of the coolant through the vapor outlet of the vapor-liquid separator, and wherein the means is configured to supply the vapor portion of the coolant through the outlet of the means.

3. The cooling system of claim 2, wherein the means for creating the pressure drop includes a venturi valve configured to create the pressure drop, and the venturi valve includes the mixer.

4. The cooling system of claim 1, wherein the second portion of the coolant circuit further includes a liquid return valve, and the liquid return valve is configured to control a flow of the liquid portion of the coolant.

5. The cooling system of claim 4, wherein a processor is configured to cause the liquid return valve to adjust the flow of the second portion of the coolant based on a temperature of the coolant supplied to the compressor.

6. The cooling system of claim 5, wherein the processor is configured to cause the liquid return valve to decrease the flow of the liquid portion in response to a decrease in a thermal load cooled by the coolant.

7. The cooling system of claim 5, wherein the processor is configured to cause the liquid return valve to increase the flow in response to an increase in a thermal load cooled by the coolant.

8. The cooling system of claim 5, wherein the processor is configured to cause the liquid return valve to increase the flow in response to a temperature of the coolant supplied to the compressor exceeding a threshold value.

9. The cooling system of claim 5, wherein the processor is configured to cause the liquid return valve to decrease the flow in response to a temperature of the coolant supplied to the compressor falling below a threshold value.

10. The cooling system of claim 4, wherein a processor is configured to cause the liquid return valve to adjust the flow of the second portion of the coolant such that a temperature of the coolant supplied to the compressor indicates that the coolant is supplied to the compressor in the vapor state.

11. A cooling system comprising:

a compressor configured to compress a coolant supplied to the compressor in a vapor state;

a gas cooler configured to cool the coolant compressed by the compressor; and a recuperator having a high pressure side and a low pressure side, wherein the recuperator is configured to receive the coolant cooled by the gas cooler at an inlet of the high pressure side, supply the coolant in the vapor state to the compressor from an outlet of the low pressure side, and transfer heat from the high pressure side to the low pressure side;

a thermal expansion valve configured to receive the coolant from an outlet of the high pressure side of the recuperator;

an evaporator configured to receive the coolant from the thermal expansion valve and to cool a thermal load with the coolant;

a vapor-liquid separator configured to receive the coolant from the evaporator and to separate the coolant into a vapor portion and a liquid portion;

a liquid return valve configured to control a flow of the liquid portion out of the vapor-liquid separator;

a pressure drop element configured to cause a pressure of the vapor portion of the coolant that exits the vapor-liquid separator to drop to a decreased pressure; and a mixer configured to form a mixture of the vapor portion of the coolant at the decreased pressure and the liquid portion, only in a liquid phase, of the coolant received through the liquid return valve, wherein the recuperator is further configured to receive the mixture at an inlet of the low pressure side.

12. The cooling system of claim 11, wherein the pressure drop element and the mixer are integral components of an eductor or an ejector.

13. The cooling system of claim 11, wherein the thermal load is imposed by a directed-energy weapon.

14. The cooling system of claim 11, wherein the evaporator is configured to cool at least two independent coolant loops with a single set of conduits that transport the coolant through sections of the evaporator that correspond to the at least two independent coolant loops.

15. The cooling system of claim 14, wherein the at least two independent coolant loops comprise a hotel coolant loop and a primary coolant loop.

* * * * *